United States Patent [19]

Kajiwara et al.

[11] Patent Number: 5,040,947

[45] Date of Patent: Aug. 20, 1991

[54] PUMP CASING

[75] Inventors: Kenichi Kajiwara, Kanagawa; Kikuichi Mori, Chiba; Hideo Ikeda; Shinichiro Arakawa, both of Kanagawa, all of Japan

[73] Assignee: Ebara Corporation, Tokyo, Japan

[21] Appl. No.: 466,843

[22] Filed: Jan. 18, 1990

[30] Foreign Application Priority Data

Jan. 19, 1989 [JP] Japan ..... 1-8618
Sep. 14, 1989 [JP] Japan ..... 1-239397

[51] Int. Cl.[5] ..... F01D 1/00

[52] U.S. Cl. ..... 415/206; 415/207; 415/215.1

[58] Field of Search ..... 415/108, 213.1, 215.1, 415/182.1, 203, 204, 206, 207, 212.1

[56] References Cited

U.S. PATENT DOCUMENTS

| | | | |
|---|---|---|---|
| 2,677,327 | 5/1954 | MacNeille et al. | 415/207 |
| 2,844,100 | 7/1958 | Heinicke . | |
| 3,412,684 | 11/1968 | Lipe . | |
| 3,620,042 | 11/1971 | Gray | 64/3 |
| 3,877,834 | 4/1975 | Speck et al. | 415/207 |
| 4,247,250 | 1/1981 | Lipe et al. | 415/215.1 |
| 4,775,295 | 10/1988 | Starke et al. | 415/219 |
| 4,826,401 | 5/1989 | Clark et al. | 415/206 |

FOREIGN PATENT DOCUMENTS

| | | |
|---|---|---|
| 3517498 | 11/1986 | Fed. Rep. of Germany . |
| 3517828 | 11/1986 | Fed. Rep. of Germany . |
| 2591514 | 6/1987 | France . |
| 57-35676 | 8/1982 | Japan . |

OTHER PUBLICATIONS

Soviet Inventions Illustrated, Derwent Publicat. Ltd., Section General/Mechanical, Accession N0C6646 K/08, Apr. 6, 1984.

*Primary Examiner*—Edward K. Look
*Assistant Examiner*—Hoang Nguyen
*Attorney, Agent, or Firm*—Armstrong, Nikaido, Marmelstein, Kubovcik & Murray

[57] ABSTRACT

A pump casing manufactured by press forming of steel plate and including a volute casing encircling a pump impeller so as to form a fluid path around the pump impeller is disclosed. The cross-sectional area of the fluid path is gradually increased towards a discharge port of the pump casing. The pump casing includes a casing body which is formed at first by press forming a metal plate into a cylindrical cup shape having an opening portion at one side thereof and a closed bottom portion at the other side of the same, and then by press forming the cylindrical cup shaped casing body so as to have a volute portion radially outwardly expanded from a cylindrical surface of the casing body at an axially intermediate portion thereof which radially opposite to the pump impeller, a casing flange outwardly extending from the opening portion and an aperture serving as a suction port at the bottom portion.

Since no separate volute member is provided within the pump casing to form the volute portion, the outer diameter of the pump casing can be made small and also the shape of the fluid path in the volute casing can be made smooth.

12 Claims, 10 Drawing Sheets

PUMP CASING

BACKGROUND OF THE INVENTION

1. Field of the Invention

The present invention relates to a pump casing manufactured by such as press forming of steel plate, and in particular, to a pump casing advantageously used for a centrifugal pump.

2. Prior Arts

A conventional pump casing manufactured by press forming of steel plate usually includes an outer casing of a cylindrical shape and a guide vane or a volute member which is separately fabricated and disposed inside of the outer casing to provide a fluid path.

FIG. 8(*a*) is a longitudinal sectional view of a pump of prior art, and FIG. 8(*b*) is a sectional view taken on line A—A of FIG. 8(*a*). In this conventional pump, the volute casing defines a volute room 4 which guides fluid delivered from an impeller 1 to an discharge port 11. The volute room 4 is composed of side plates 5 and 6 disposed at each side, a peripheral plate 7 provided along the periphery of the side plates 5 and 6, and a volute vane or volute member 8 disposed in a space defined by the side plates and the peripheral plate and extended in a circumferential direction along a predetermined distance. These side plates 5 and 6, the peripheral plate 7 and the volute vane 8 are all manufactured by press forming of metal plates. In going from a starting point 8*a* of the volute to a predetermined point 8*b*, the volute casing is radially deviated outwardly, thereby increasing the cross-sectional area of the fluid path within the volute casing in going towards the discharge port. Beyond the predetermined point 8*b*, the volute casing is deviated in an axial direction as denoted by 5*a* for increasing the cross-sectional area of the fluid path in going towards the discharge port 11. Thus, the cross-sectional area of the fluid path is gradually increased from the line I—I to line IV—IV [FIG. 8(*b*)].

In the above-mentioned prior art, since the side plates 5 and 6, the peripheral plate 7, the volute vane 8 and an outer plate 9 are all manufactured by press forming of metal plates, the casing can be manufactured with easier fabrication and lower cost in comparison with the manufacturing method of casting. Further, by deviating the volute fluid path in both radial and axial directions, it becomes possible to decrease the radial dimension of the pump to some extent, and to thereby decrease the cost.

In the above-mentioned prior arts, however, since the volute vane 8 is disposed inside of the pump casing, the outside diameter of the outer casing inevitably become greater. In consequence, there is a problem that it is required to increase the thickness of the casing to increase the strength against the internal fluid pressure, and to reinforce the casing to prevent deformation of the side walls of the casing. When the volute portion is expanded in an axial direction to decrease the radial excessive space required for arranging the volute vane 8 outside of the impeller as mentioned above, the pump performance deteriorates.

Further, in the above-mentioned cases, since the shape of the fluid path is not smooth at the region where the fluid flows out from inside of the fluid path to outside of the same, two problems are caused, generation of noise and deterioration of efficiency.

SUMMARY OF THE INVENTION

Therefore, the object of the present invention is to solve the above-mentioned problems of prior arts, and to provide a pump casing which directly defines a fluid path without providing any separate fluid path member, i.e., volute vane, inside an outer cylindrical casing manufactured by press forming.

For achieving the above-mentioned object, the present invention is characterized in that the pump casing is at first formed by press forming a metal plate to form a casing body of a cylindrical cup shape having an opening portion at one side thereof and a closed bottom portion at the other side, and then by press forming said casing body so as to form a casing flange outwardly extending from said opening portion, an aperture serving as a suction port at said bottom portion, and a volute portion radially outwardly expanded from a cylindrical surface of said casing body at an axially intermediate portion thereof which is radially opposite to an impeller upon assembling.

Further, the present invention is characterized in that the maximum expanded portion of said volute portion formed by press forming at the intermediate cylindrical portion of said casing body is provided with an opening and this opening is connected with an discharge port through a nozzle which is shaped and welded so as to have a smooth fluid path.

The above-mentioned volute portion radially outwardly expanded from the surface of the intermediate cylindrical portion of the casing body is formed by so-called bulgeforming, i.e. through steps of setting the cylindrical cup shaped casing body formed with the outwardly extended casing flange at one opening side and the closed bottom portion at the other side in a female die having a recess on its inner surface corresponding to the volute portion, and of applying an internal pressure on the inner surface of the intermediate cylindrical portion and, at the same time, pushing upwards the bottom portion of the casing body for fitting the same to the inner surface of the female die.

As stated above, in the present invention, firstly, a cup-shaped cylindrical casing body having an opening portion on its one side and a closed bottom portion on the other side is manufactured by press forming a steel plate. Then, the intermediate cylindrical portion of the casing body, which is opposite to the pump impeller upon assembling, is integrally formed on its inner surface with a volute portion radially gradually expanded by means of such conventional bulge forming. In operating the pump, the pump casing is fixed to the driving means through a casing cover fixed within the opening portion at one side of the casing body, a suction flange is connected with the suction port formed in the casing body and the impeller disposed inside of the casing is started to rotate. Thus, in this operation of the pump, the fluid is sucked from the suction port formed at the bottom portion of the casing body through the suction flange, pressurized by the impeller, collected into the volute portion inside of the casing body, guided to the discharge port through the nozzle defining smooth fluid path from the maximum expanded portion of the volute portion, and exhausted to the outside.

In this invention, since the volute portion is integrally formed to gradually expand from the casing body as mentioned above, a fluid path inside the casing body becomes smoother in comparison with that of prior art. Further, the shape of the fluid path from the volute portion (expanded portion), through the nozzle to the discharge port has a smooth one. In consequence, differently from the pump of prior art having a volute member internally provided, the pump according to the present invention includes neither step nor clearance between the volute portion and the pump casing (outer casing), thereby preventing any deterioration of the performance and any generation of noise.

On the other hand, since the diameter of the pump casing is smaller than that of prior arts, the plate thickness of the casing supporting the internal pressure may be decreased, and the stiffness of the casing is also increased.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWINGS

FIG. 1(*b*) is a longitudinal sectional view of a centrifugal pump according to another embodiment of the invention;

FIG. 3(*b*) is a sectional view taken on line A—A of FIG. 1;

FIG. 3(*c*) is a illustrative view showing section of the expanded volute portion;

FIG. 8(*b*) is a sectional view taken on line A—A of FIG. 8(*a*).

DETAILED DESCRIPTION OF THE PREFERRED EMBODIMENTS

Figure 1:
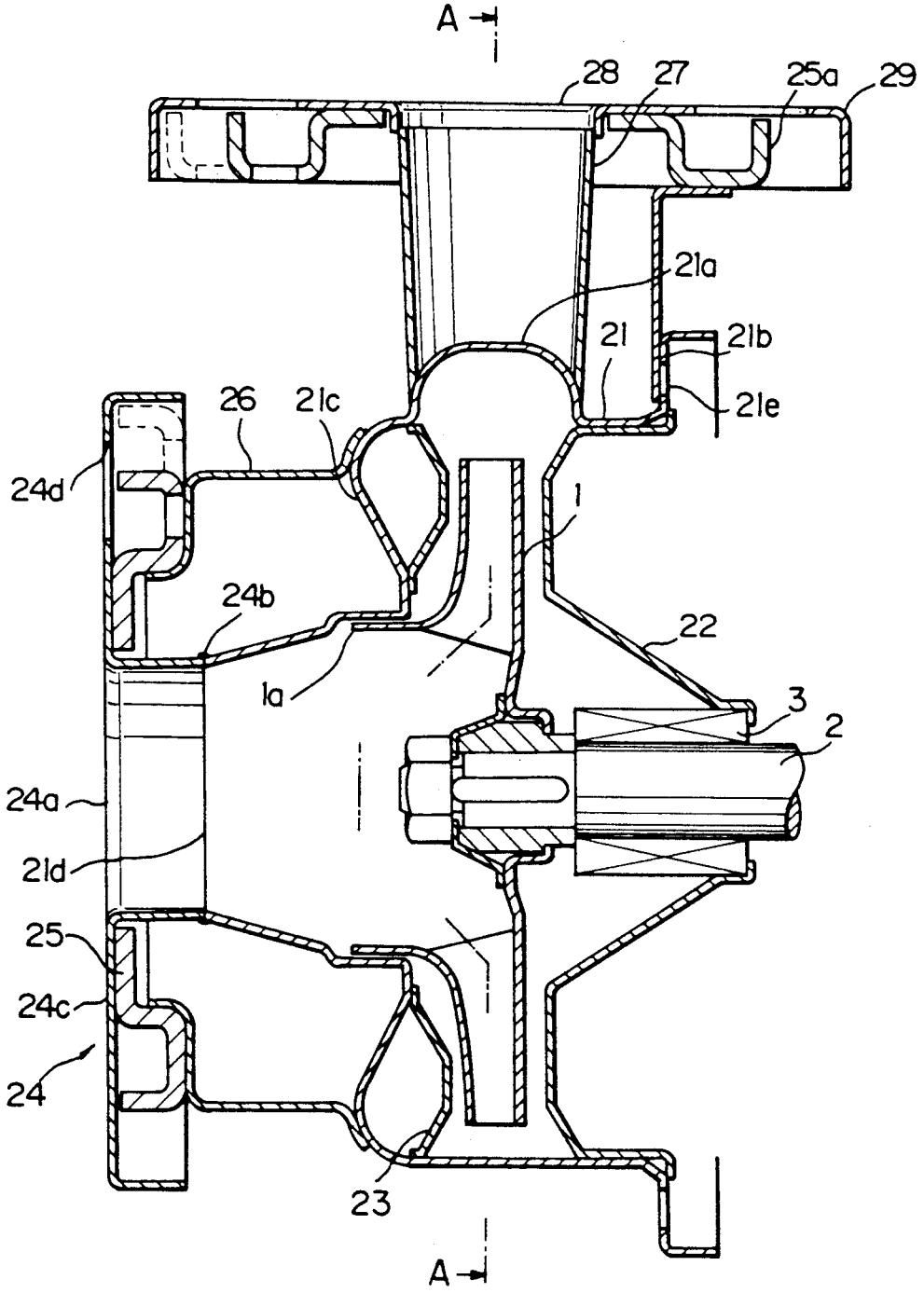
FIG. 1(*a*) is a longitudinal sectional view of a centrifugal pump according to an embodiment of the present invention.
Figure 1B:
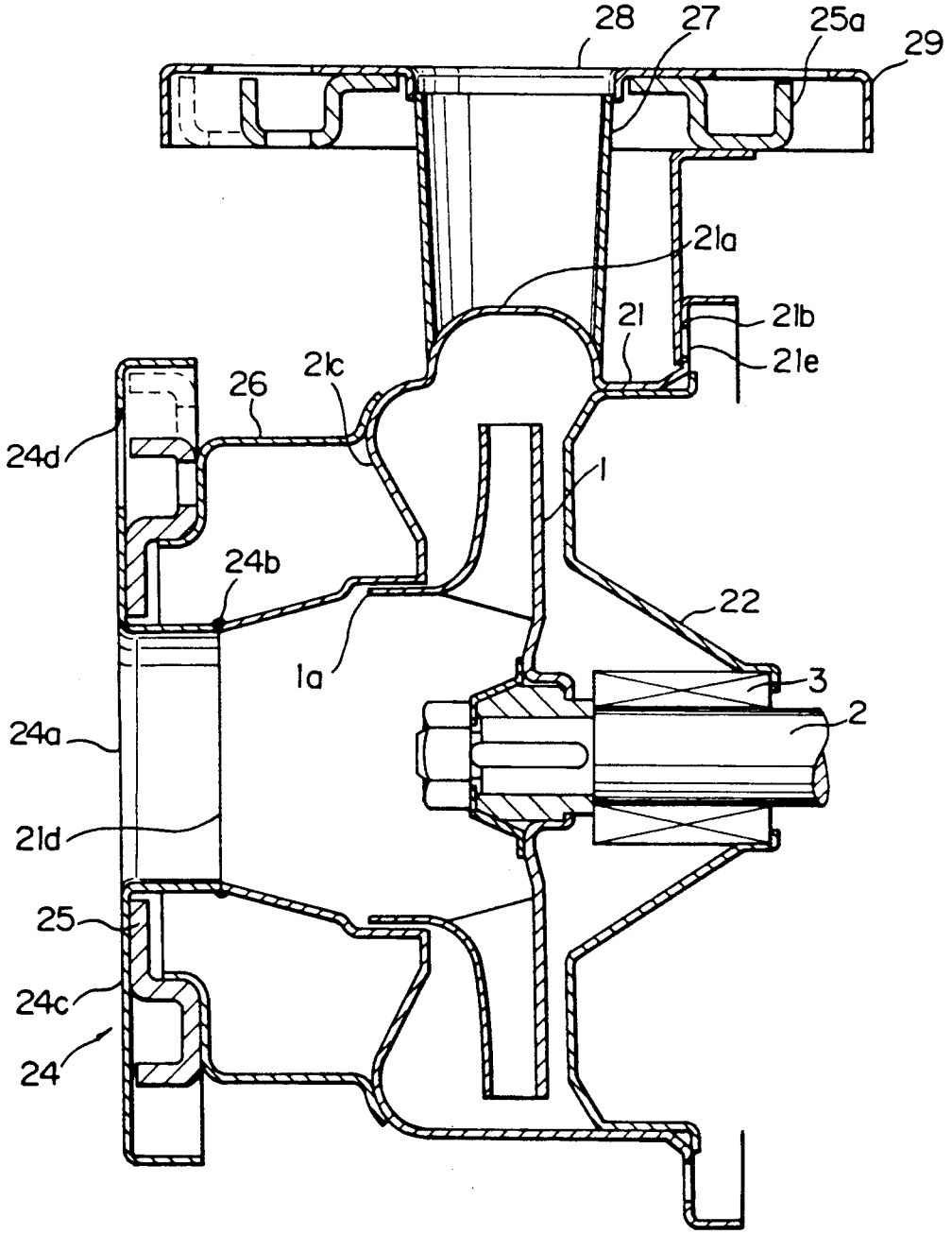

Referring to the drawings, embodiments of the present invention will be described below.

Figure 8:
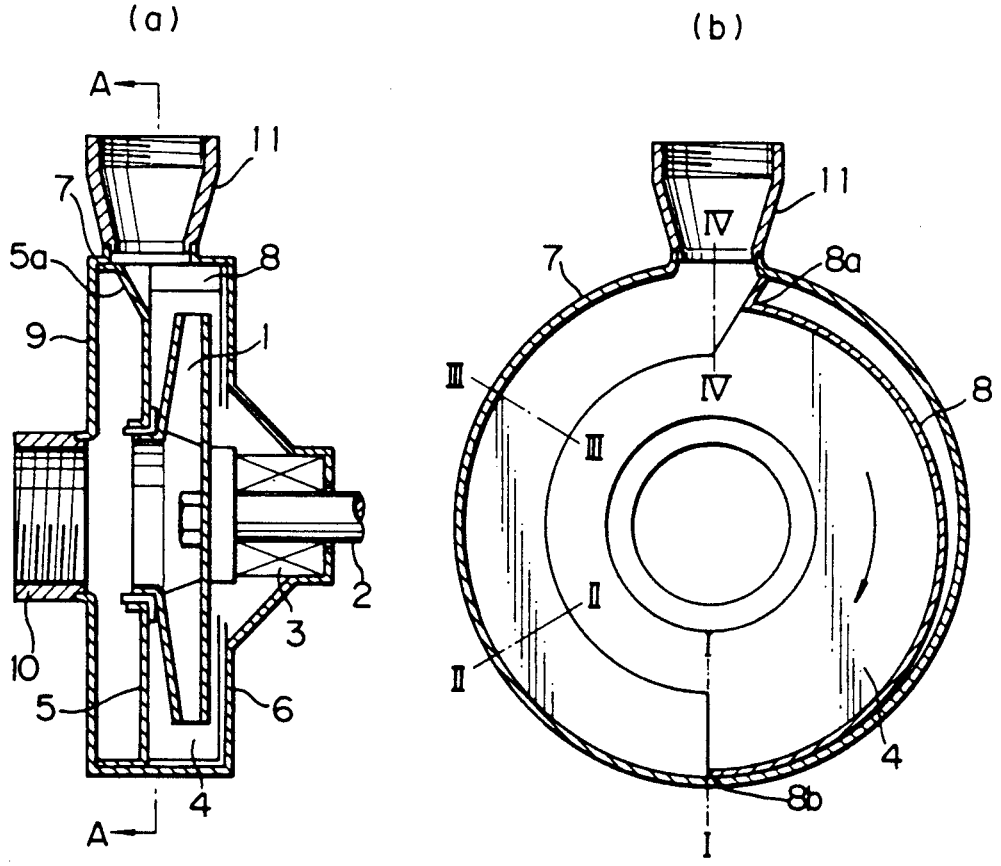
FIG. 8(*a*) is a longitudinal sectional view of a conventional centrifugal pump.

FIG. 1(*a*) is a longitudinal view of a centrifugal pump having a pump casing made of steel plate according to an embodiment of the present invention, where the same numerals as in FIG. 8(*a*) indicate the same or similar portions.

Figure 5:
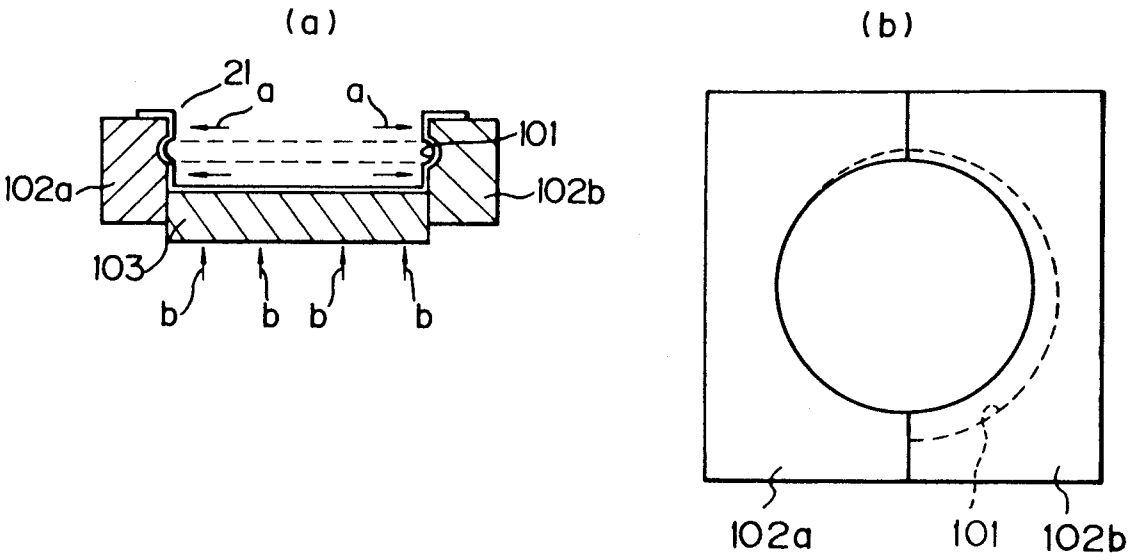
FIGS. 5(*a*) and 5(*b*) are illustrative views for showing the process of press forming a volute portion by bulge forming.

In the figure, numeral 21 denotes a casing body. This casing body 21 is at first manufactured by press forming or deep drawing of a steel plate to form a cylindrical cup-shaped casing body having an opening portion surrounded by a flange on one side and a closed bottom portion on the other side, then setting said cup-shaped casing body 21, as shown in FIGS. 5(*a*) and 5(*b*), inside of separated female dies 102*a* and 102*b*, which are formed on their inner surfaces with a recess 101 corresponding to the volute portion having a gradually increasing cross-sectional area for the fluid path, and applying an internal pressure, through press forming like so called bulge forming, on the inner surface of the intermediate cylindrical portion of the cup-shaped casing body 21 set inside the dies in directions indicated with arrows a by means a hydraulic force or an elastic material, together with pushing the cup-shaped casing body upwards in a direction indicated with arrows b through a female die 103. Thus, an expanded portion 21*a* corresponding to the volute portion which is to be disposed at a region radially opposite to the pump impeller upon assembling is formed in the intermediate cylindrical portion of the casing body 21. Then, a casing flange 21*b* is formed at the opening portion on the driving side; and a casing front portion 21*c* and a pump suction port 21*d* axially projecting at the central portion thereof are formed at the bottom portion on the other side, i.e. suction side (left side in the figure). These portions are integrally formed by press forming.

The above-mentioned casing flange 21*b* of the casing body 21 is fixed through a casing cover 22 to the driving side such as a bearing or a driving motor. The casing front portion 21*c* includes an outwardly expanded portion, inside of which is provided with a volute inner wall 23 which is opposites to a shroud of the impeller 1. By providing the outwardly expanded portion in the casing front portion, the stiffness of the casing body is significantly increased.

Further, a suction flange 24 having a concentric suction port 24*a* at the central portion thereof is connected with the suction port 21*d* of the casing body 21 by welding 24*b*. On the rear side of the suction flange 24 opposite to the flange surface 24*c*, a reinforcing plate 25 is fixed and is supported on the casing body 21 through a cylindrical support member 26. The support member 26 also serves to prevent any inclination of the suction flange 24 due to an external force or impact acting on the flange.

Figure 3:
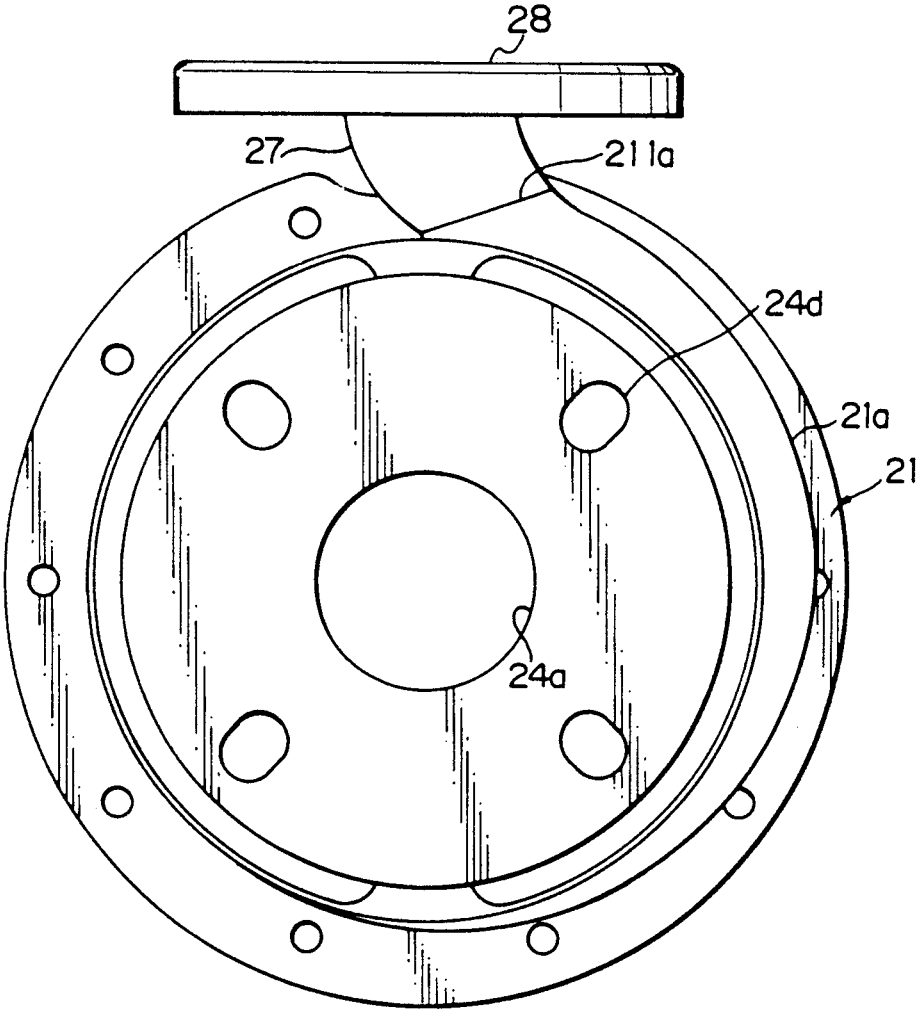
FIG. 3(*a*) is a front view of the pump shown in FIG. 1.
Figure 3B:
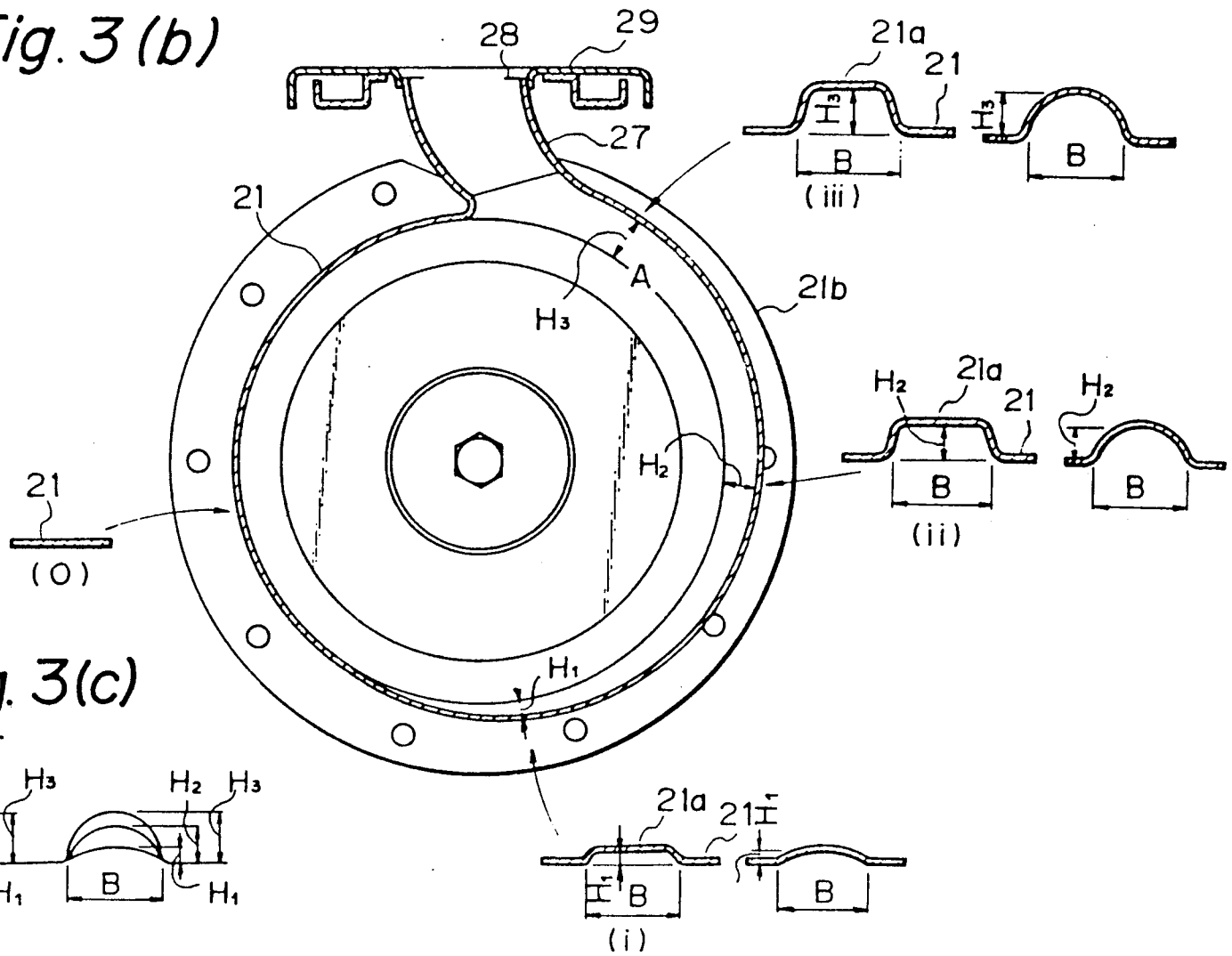
Figure 3C:
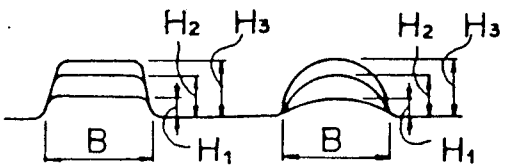
Figure 4:
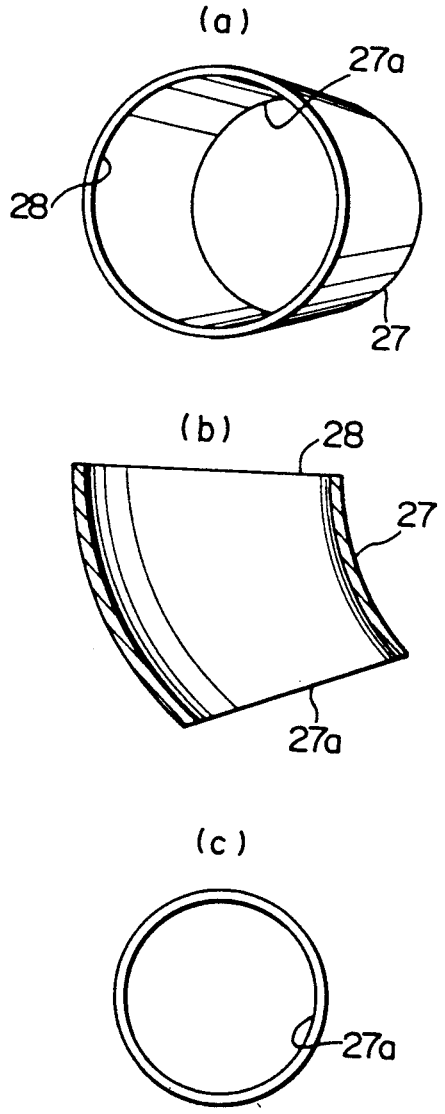
FIG. 4(*a*), 4(*b*), and 4(*c*) are a plan view, a longitudinal sectional view, and a bottom view of the nozzle, respectively.

An opening is provided at the widest portion of the volute expanded portion 21*a* where the fluid path sectional area is maximum and is located at the highest portion as shown in FIG. 3(*a*). The edge portion 211*a* of said opening has substantially a circular shape identical with that of the edge portion 27*a* of the nozzle 27 shown in FIG. 4(*c*), which is to be secured to the edge portion 211*a* by welding and connected with the discharge port 28 for defining a smooth fluid path. In the figures, numeral 3 denotes a sealing device, 21*e* bolt holes provided in the casing flange 21*b*, 24*d* bolt holes provided in the flange surface 24*c*, 25*a* a reinforcing plate secured on an discharge flange 29.

FIG. 3(*b*) and FIG. 3(*c*) show the shape of the volute portion thus formed. Namely, a volute room A which is defined by the circumferential expanded portion 21*a* is formed in the wall of the intermediate cylindrical portion of the casing body 21 by radially outwardly expanding the outer wall of the casing body 21 as stated above. The expansion is started from a circumferentially intermediate point of the casing body and the height H of which is gradually increased from $H_1$ to $H_3$ in the circumferential direction (counterclockwise direction in this case) while maintaining the width B thereof constant as shown in (o) to (iii) in FIG. 3(*b*) or FIG. 3(*c*). Thus, the sectional area of the flowing path of the volute room A is gradually increased toward the fluid flow direction. By maintaining the width B of the expanded portion constant value, the water discharged from the impeller may smoothly flow into the volute room and thereby improve the hydraulic efficiency of the pump.

The expanded portion 21*a* may have trapezoidal or circular section as shown in FIG. 3(*b*) or FIG. 3(*c*). When the expanded portion is formed through the bulge forming, however, a circular section is preferable, as it has the following advantageous effects.

(1) The contact area between the water and the expanded volute portion is relatively small, which decreases resistance of fluid flow and improves the hydraulic efficiency of the pump.

(2) The thickness of the casing wall is an expanded portion may be maintained uniform after bulge forming which increases the strength of the casing.

(3) An internal pressure upon the bulge forming may be set to be relatively low which improves the forming property. The forming of the expanded portion having a trapezoidal section needs a larger internal pressure for forming the corner of the section.

For operating the pump, the pump casing is mounted on the driving side through the casing flange 21*b*and the casing cover 22, and the impeller disposed inside of the pump casing is rotated. Then, by virtue of the above-mentioned arrangement, the fluid is sucked through the suction port 24*a* of the suction flange 24 and the suction port 21*d* formed in the bottom portion of the casing body 21, pressurized by the impeller 1, collected in the volute portion 21*a* in the casing body, guided to the discharge port 28 through the nozzle 27 which is connected with the widest portion of the volute expanded portion so as to define a smooth fluid path, and then exhausted to the outside.

Figure 6:
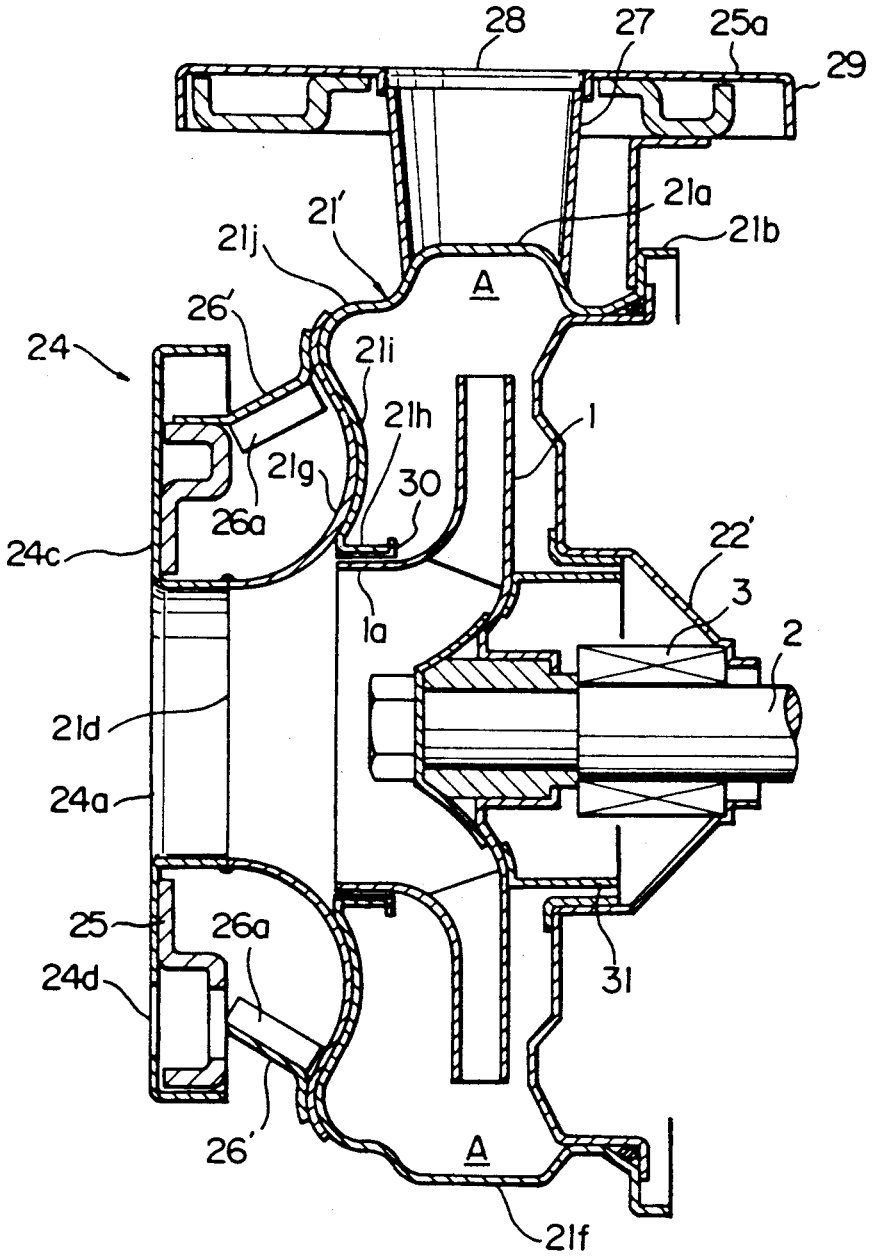
FIG. 6 is a longitudinal sectional view of a centrifugal pump according to a still another embodiment of the present invention.

In this embodiment, since the volute portion 21*a* is integrally formed to gradually expanded from the casing body 21, the fluid path becomes smoother in comparison with that of prior art [FIGS. 6(*a*) and 6(*b*)]. Further, since the shape of the fluid path from the volute portion 21*a* having a gradually increasing sectional area of the fluid path, through the nozzle 27 to the discharge port 28 is made smoother, the pump casing according to the present invention includes, differently from the pump of prior art having a volute member internally interposed, neither step nor clearance between the volute portion and the pump outer casing, thereby preventing any deterioration of the pump performance or any generation of noise. On the other hand, since the diameter of the pump casing can be made smaller than that of prior arts, the plate thickness of the casing for supporting the internal pressure may be decreased, and the stiffness of the casing is also increased. In addition, the size and number of bolts to be inserted into the bolt holes 21*e* of the casing flange 21*b* can be decreased accordingly.

FIG. 1(*b*) is a longitudinal sectional view of a centrifugal pump according to another embodiment of the present invention. In this figure, the same numerals as in FIG. 1(*a*) indicate the same or similar portions. In this embodiment, the volute inner wall 23 of the first embodiment is eliminated. It was confirmed that neither of pump performance nor the strength of the pump casing is notably deteriorated even if the volute inner wall 23 is eliminated, and thereby the construction of the pump casing may further be simplified.

Figure 2:
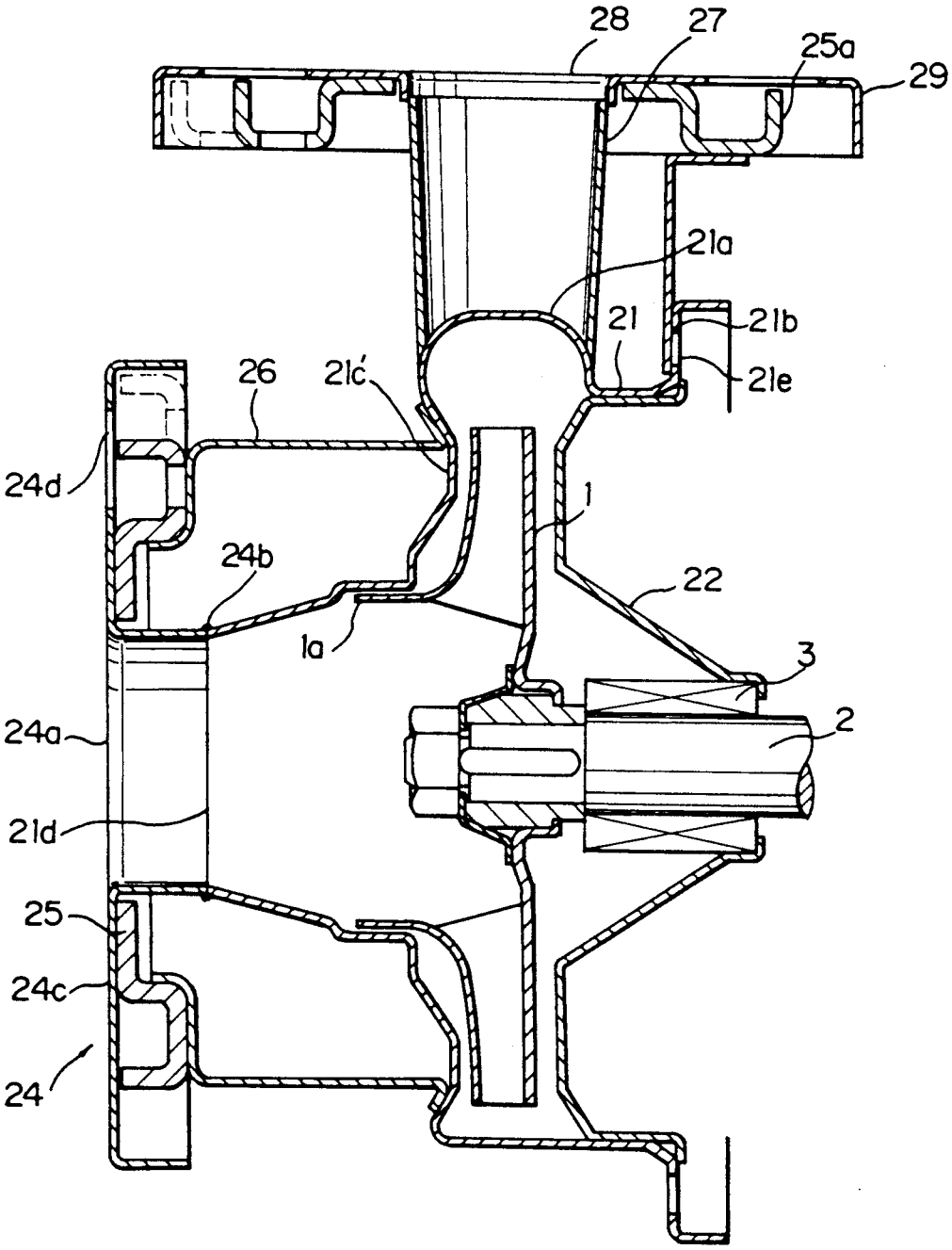
FIG. 2 is a longitudinal sectional view according to a further embodiment of the invention.

FIG. 2 is a longitudinal sectional view of a pump according to further embodiment of the present invention, where the same numerals as in FIG. 1 indicate the same portion. In this embodiment, instead of providing the volute inner wall 23 shown in FIG. 1, the volute front portion 21*c*' is so formed as to have a shape substantially identical to that of the volute inner wall. According to this embodiment, when compared with the embodiment shown in FIG. 1(*a*), no volute inner wall is required and the manufacturing become easier, but the same pump performance can be obtained.

Figure 7:
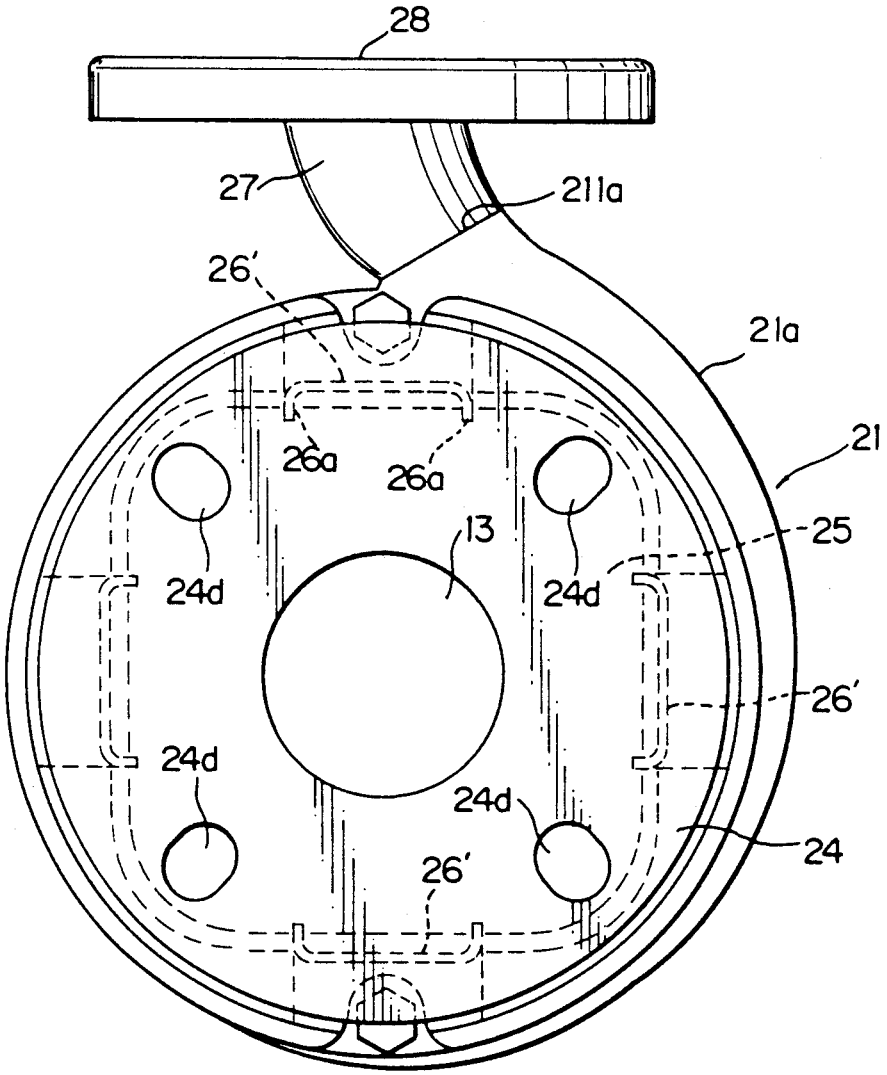
FIG. 7 is a front view of the pump shown in FIG. 6.

FIGS. 6 and 7 respectively show a longitudinal sectional view and a front view of a centrifugal pump according to a still further embodiment of the invention, and where the same numerals as in FIG. 1 indicate the same or similar portions. In this embodiment, the casing body 21' is constituted of two separate portions, i.e. a casing shell 21*f* and a reinforcing member 21*g*.

The casing shell 21*f* is manufactured by press forming a stainless steel plate so as to have a fixing flange 21*b* on one end thereof, and expanded volute portion 21*a* at the intermediate cylindrical portion thereof, and an inwardly bent partition wall 21*h* on the other end of the casing shell. The expanded volute portion 21*a* is formed by radially expanding the intermediate cylindrical wall of the casing shell through bulge forming like in the embodiments stated above.

A wall portion 21*i* of the casing shell 21*f* located on the suction side is formed with an outwardly projecting shoulder portion 21*j* for increasing the stiffness of the casing shell, and the before-mentioned inwardly bent partition wall 21*h* is integrally formed at the end of the wall portion 21*i*. On the inner periphery of the partition wall 21*h* is press-fitted a liner ring 30, on the inner periphery of which is fitted a tip portion 1*a* of the impeller 1 with a play maintained therebetween.

To the outer surface of the wall portion 21*i* is secured the reinforcing member 21*g* to provide a double structure over a substantially whole area of the wall portion 21*i*. The reinforcing member 21*g* manufactured by press forming has a suction port 21*d* at its outer end portion, with which a separate suction flange 24 is connected by welding.

Between the reinforcing member 21*g* and the suction flange 24 are arranged four support members 26', each of which includes bent portions 26*a* on both side edges, and having a U-shaped cross section as shown in FIG. 7. An end of each support member 26' is fixed to the outer surface of the reinforcing member 21*g* and the other end of each support member 26' is fixed to the side surface of the reinforcing plate 25.

In the figure, the numberal 31 denotes a liner ring fixed to the rear side of the impeller 1.

The pump of this embodiment has the following advantageous effects in addition to the effects of the aforementioned embodiments.

In this embodiment, when an external force acts on the suction flange 24, the external force is transmitted to the fixing flange 21*b* through the reinforcing member 21*g* and the wall portion 21*i* constituting the double wall and the casing shell shoulder portion 21*j*. In such a case, since the reinforcing member 21*g* and the wall portion 21*i* constitute a double wall, the casing shell 21*f* suffers only minimum deformation from the external force. Therefore, it is possible to avoid any collision between the liner ring 30 and the end portion 1*a* of the impeller 1.

Further, since a plurality of support members 26' having a U-shaped cross section are provided between the reinforcing member 21*g* and the suction flange 24, any inclination of the suction flange due to an external force is positively prevented by virtue of the support member 26'.

According to the present invention, the following advantages can be obtained:

(1) Since the volute portion is integrally formed to gradually outwardly expand from the casing body, the shape of the fluid path in the volute room becomes smoother in comparison with that of prior art which includes a separate additional volute member, and, as a result, the fluid flow resistance is decreased and the pump performance is improved.

(2) Since the diameter of the pump casing can be made smaller than that of a pump of prior art, the plate thickness of the casing supporting the internal pressure may be decreased and the stiffness of the casing is also increased. In addition, the size and number of bolts for the casing flange can be both decreased.

(3) Since the shape of the fluid path from the volute portion, through the nozzle to the discharge port can be made smoother, the pump casing includes, neither step nor clearance between the volute portion and the pump casing, thereby preventing any deterioration of the pump performance or any generation of noise.

(4) When the casing body is constituted by two separated members, i.e. a casing shell and a reinforcing member arranged so as to constitute a double wall on the outer surface of the casing shell at the suction side, deformation of the casing body due to an external force acting on the suction flange can be significantly suppressed, and collision between the casing body and the impeller can be surely avoided.

(5) Further, where support members are arranged between the reinforcing member and the suction flange, inclination of the suction flange can be surely prevented by them.

Although the present invention has been described through specific term, it should be noted here that the described embodiment is not necessarily exclusive and various changes and modifications may be imparted thereto without departing from the scope of the invention which is limited solely by the appended claims.

What is claimed is:

1. A pump casing manufactured by press forming of steel plate and including a volute casing encircling a pump impeller so as to form a fluid path around said pump impeller, the cross-sectional area of said fluid path being gradually increased towards an discharge port of said pump casing, characterized in that said pump casing includes a casing body formed at first by press forming a metal plate into a cylindrical cup shape having an opening portion at one side thereof and a closed bottom portion at the other side of the same, and then by bulge forming said cylindrical cup shaped casing body so as to have a volute portion radially outwardly expanded from a cylindrical surface of said casing body at an axially intermediate portion thereof which is radially opposite to said pump impeller, a casing flange outwardly extending from said opening portion and an aperture serving as a suction port at said bottom portion.

2. A pump casing claimed in claim 1, wherein the height of said expanded volute portion is gradually increased in the circumferential direction while maintaining the width thereof as constant.

3. A pump casing claimed in claim 2, wherein said expanded volute portion has a trapezoidal or circular section.

4. A pump casing claimed in any one of claims 1, 2, or 3 wherein the maximum expanded portion of said volute portion is provided with an opening and is connected with said discharge port through a nozzle shaped so as to form a smooth fluid path.

5. A pump casing claimed in any one of claims 1, 2, or 3, wherein a suction flange is welded to said suction port of said casing body.

6. A pump casing claimed in any one of claims 1, 2, or 3, wherein a reinforcing plate is fixed on the rear side of said suction flange, and a cylindrical support member is provided between said reinforcing plate and a front surface of said casing body.

7. A pump casing claimed in any one of claims 1, 2, or 3, wherein said casing body is provided with an outwardly expanded portion on a suction side wall of said casing body.

8. A pump casing claimed in any one of claims 1, 2 or 3, wherein a volute inner wall is provided inside of said casing body to form a portion of said fluid path.

9. A pump casing claimed in any one of claims 1, 2, or 3, wherein a suction side wall of casing body is press formed so that it constitutes a portion of said fluid path.

10. A pump casing claimed in any one of claims 1, 2 or 3, wherein said casing body is constituted of two separated members, i.e. a casing shell defining said expanded volute portion and a reinforcing member defining said suction port, each formed by press forming, said casing shell and said reinforcing member being arranged so as to constitute a double wall on the outer surface of the suction side of said casing body.

11. A pump casing claimed in claim 10, wherein said casing shell includes an inwardly bent partition wall on the radially inner end of said casing shell, a liner ring being press-fitted on the inner periphery of said partition wall, and a tip portion of said impeller being fitted on the inner periphery of said liner ring with a play maintained therebetween.

12. A pump casing claimed in claims 11, wherein a reinforcing plate is fixed on the rear side of said suction flange, and a plurality of support members are provided between said reinforcing plate and a front surface of said casing body, each of said support members include bent portion on both side edges thereof.

* * * * *